US008509646B2

(12) United States Patent
Shimizu

(10) Patent No.: US 8,509,646 B2
(45) Date of Patent: Aug. 13, 2013

(54) IMAGE FORMING APPARATUS

(75) Inventor: Keisuke Shimizu, Komae (JP)

(73) Assignee: Ricoh Company, Ltd., Tokyo (JP)

( * ) Notice: Subject to any disclaimer, the term of this patent is extended or adjusted under 35 U.S.C. 154(b) by 304 days.

(21) Appl. No.: 12/923,029

(22) Filed: Aug. 30, 2010

(65) Prior Publication Data

US 2011/0064449 A1 Mar. 17, 2011

(30) Foreign Application Priority Data

Sep. 11, 2009 (JP) ..... 2009-210677

(51) Int. Cl.
*G03G 21/20* (2006.01)

(52) U.S. Cl.
USPC ..... 399/92; 399/93

(58) Field of Classification Search
USPC ..... 399/92, 93
See application file for complete search history.

(56) References Cited

U.S. PATENT DOCUMENTS

| | | | | |
|---|---|---|---|---|
| 7,322,881 | B2 * | 1/2008 | Ishii | 454/155 |
| 7,522,874 | B2 | 4/2009 | Suzuki | |
| 7,941,088 | B2 | 5/2011 | Suzuki | |
| 2006/0051123 | A1 * | 3/2006 | Awaya | 399/92 |
| 2006/0228139 | A1 | 10/2006 | Suzuki | |
| 2007/0268321 | A1 * | 11/2007 | Kawamata | 347/15 |
| 2009/0116865 | A1 * | 5/2009 | Hanano | 399/92 |
| 2009/0169224 | A1 | 7/2009 | Suzuki | |
| 2009/0297191 | A1 * | 12/2009 | Hirai et al. | 399/49 |
| 2011/0170883 | A1 | 7/2011 | Suzuki | |

FOREIGN PATENT DOCUMENTS

| | | |
|---|---|---|
| CN | 1847997 | 10/2006 |
| JP | 2006-078534 | 3/2006 |
| JP | 2006-195357 | 7/2006 |
| JP | 2008-250284 | 10/2008 |

OTHER PUBLICATIONS

Office Action dated Jun. 18, 2012 issued in corresponding Chinese Application No. 2010175866.5.

* cited by examiner

*Primary Examiner* — Walter L Lindsay, Jr.
*Assistant Examiner* — Barnabas Fekete
(74) *Attorney, Agent, or Firm* — Harness, Dickey & Pierce P.L.C.

(57) ABSTRACT

An image forming apparatus such as a color printer including a fixing device and air supply and exhaust members, capable of effectively exhausting hot, moist air and preventing condensation from forming in and around a sheet conveyance path. The image forming apparatus includes an exhaust fan mounted at a predetermined angle to the sheet conveyance path above the fixing device, with an exhaust airflow path of the exhaust fan narrowing toward a downstream side in the air exhaust direction.

20 Claims, 11 Drawing Sheets

IMAGE FORMING APPARATUS

CROSS-REFERENCE TO RELATED APPLICATIONS

The present application claims priority from Japanese patent application number 2009-210677, filed on Sep. 11, 2009, the entire contents of which are hereby incorporated by reference herein.

BACKGROUND OF THE INVENTION

1. Field of the Invention

The present invention relates to an image forming apparatus using an electrophotographic process, such as a facsimile machine, a printer, or a multifunctional machine combining functions thereof, and more particularly, to a technology to discharge heat and prevent moisture generated in the image forming and image fixing devices employed in the image forming apparatus.

2. Discussion of the Related Art

With recent advances in electrophotographic image forming apparatuses such as high-speed multicolor apparatuses, demand for greater compactness has also become acute. As a result, parts or components have come to be mounted more closely together and the problem of cooling these components has become a critical issue. In particular, with the development of high-speed multicolor machines, the self-heat generation amount in the imaging unit (i.e., image forming device) has increased, necessitating heat discharge or cooling so that toner inside the image forming device does not melt or solidify. With the trend toward greater compactness, a fixing device, a transfer device, and the image forming device are now mounted close to each other, which may give an adverse effect to these peripheral devices due to the heat generated by the fixing device.

In order to solve such problems, conventionally, there are image forming apparatuses capable of cooling the fixing device and the proximally provided image forming device (e.g., JP-2006-078534-A, JP-2006-195357-A, and JP-2008-250284-A). For example, JP-2006-078534-A discloses an image forming apparatus which includes a ventilation duct having an air passage to cool a controller board of the fixing means and another air passage to cool a portion around the image carrier, thereby cooling the controller board and the image carrier and their peripheral portions.

The image forming apparatus disclosed in JP-2006-078534-A including the ventilation duct requires a duct space from each air inlet to the objects to be cooled. Thus, the machine size needs to be enlarged and the requirement for greater compactness cannot be met.

As a solution to the above heat discharge problem, it is conceivable to provide an exhaust fan above the fixing device to discharge moist, hot air directly generated by the fixing device to an outside of the apparatus body. However, if, in a case of an image forming apparatus of a vertical-sheet-conveyance type, in which a printed sheet is discharged onto an upper surface of the apparatus, or a type provided with a sheet duplex unit for duplex printing, and a compact and ventilation-effective, axial-flow fan is arranged as an exhaust fan above the fixing device, the exhaust direction of the axial-flow fan is along the fan axis. Thus, if the exhaust direction is with the same as a sheet conveyance path, the exhaust fan lies across and blocks the sheet conveyance path. Even though the exhaust fan is provided parallel to and offset from the sheet conveyance path so as not to block the sheet conveyance path, the width of the exhaust fan intersects the sheet conveyance path, thereby generating wasted space, which is inconsistent with the requirement of greater compactness.

Accordingly, to meet the requirement of greater compactness, without providing the exhaust fan (axial-flow fan) such that the exhaust direction is the same as or parallel to the sheet conveyance path, it is conceivable that, in order to avoid wasted space, the axial direction of the exhaust fan is provided either perpendicular or at a predetermined angle to the sheet conveyance path, thereby achieving a more compact machine size. However, with such an arrangement, there may occur a problem of condensation, in which parts or components-provided downstream of the exhaust fan in the exhaust direction tend to be exposed to hot, humid wind generated when the fixing device heats the moisture-absorbing sheet, and after the main power is turned off and the exhaust fan is stopped, highly moist air around the parts or components is cooled by outside air below the dew point, whereby condensation occurs. If condensation does occur, water droplets fall from the parts or components and adhere to lower-lying components such as the exhaust fan, the upper surface of the fixing device, the sheet conveyance path and the like may cause various disadvantages. In particular, if the droplets are attached to the sheet conveyance path, the sheet becomes wet in the next conveying operation, risking defective results such as wet output images and defective sheet conveyance due to sticking of the sheet to the sheet conveyance path.

For these reasons, a need exists for an image forming apparatus capable of effectively discharging the heat and moisture generated in the fixing device and preventing condensation around the sheet conveyance path, without increasing the overall size of the apparatus.

SUMMARY OF THE INVENTION

Accordingly, the present invention provides a novel image forming apparatus configured to include a fixing device to fix an image to a sheet with heat and pressure, an air exhaust member to exhaust air having a high temperature and moisture generated by the fixing device and an exhaust fan provided in the exhaust member, in which the exhaust fan is mounted so that an axial direction thereof has a predetermined angle with a sheet conveyance path at an upper part of the fixing device, and an exhaust airflow path at a downstream in the air exhaust direction of the exhaust fan is configured to be narrower than the airflow path at an upstream in the air exhaust direction.

Thus, the image forming apparatus effectively exhausts air having a high temperature and moisture and prevents dew condensation around the sheet conveyance path.

These and other objects, features and advantages of the present invention will become apparent upon consideration of the following description of the preferred embodiments of the present invention when taken in conjunction with the accompanying drawings.

DESCRIPTION OF THE PREFERRED EMBODIMENTS

An embodiment of the present invention will now be described with reference to drawings.

Figure 1:
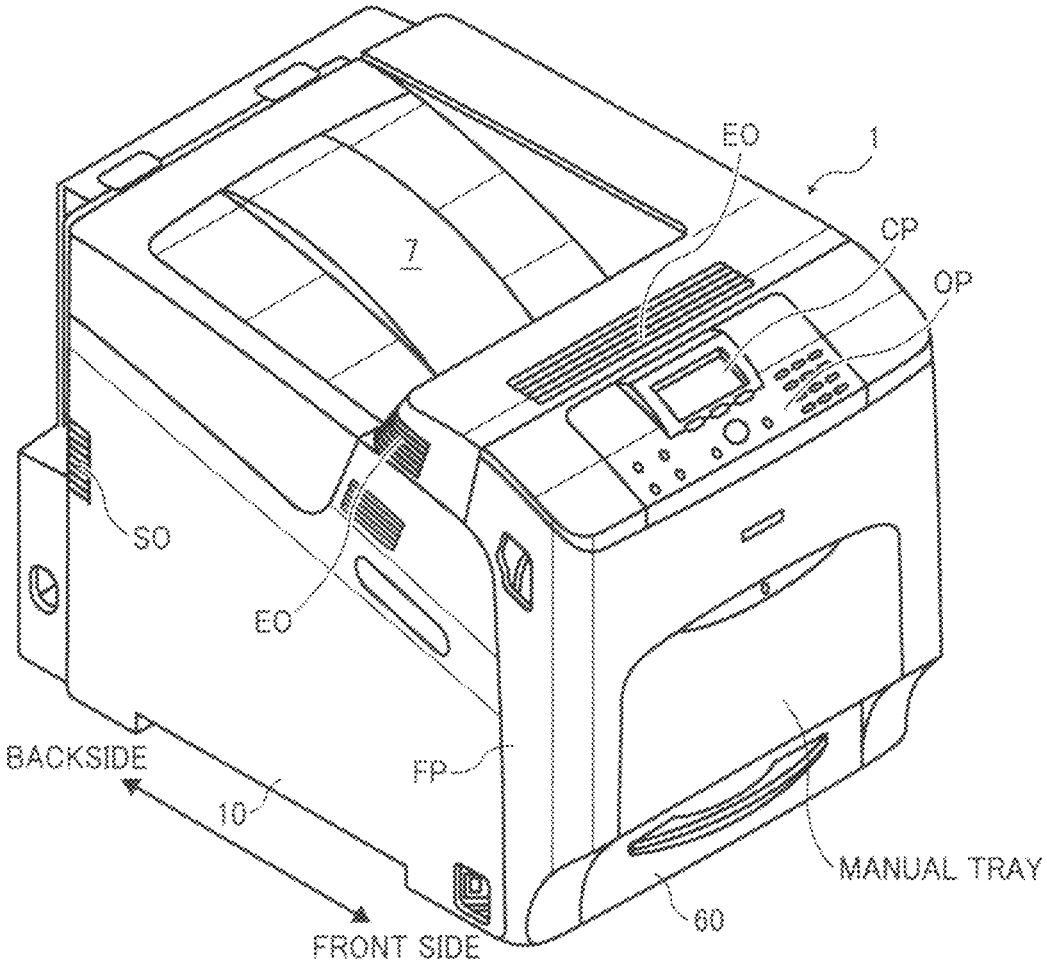
FIG. 1 is an oblique view showing an entire configuration of a color printer as an image forming apparatus according to an embodiment of the present invention.
Figure 2:
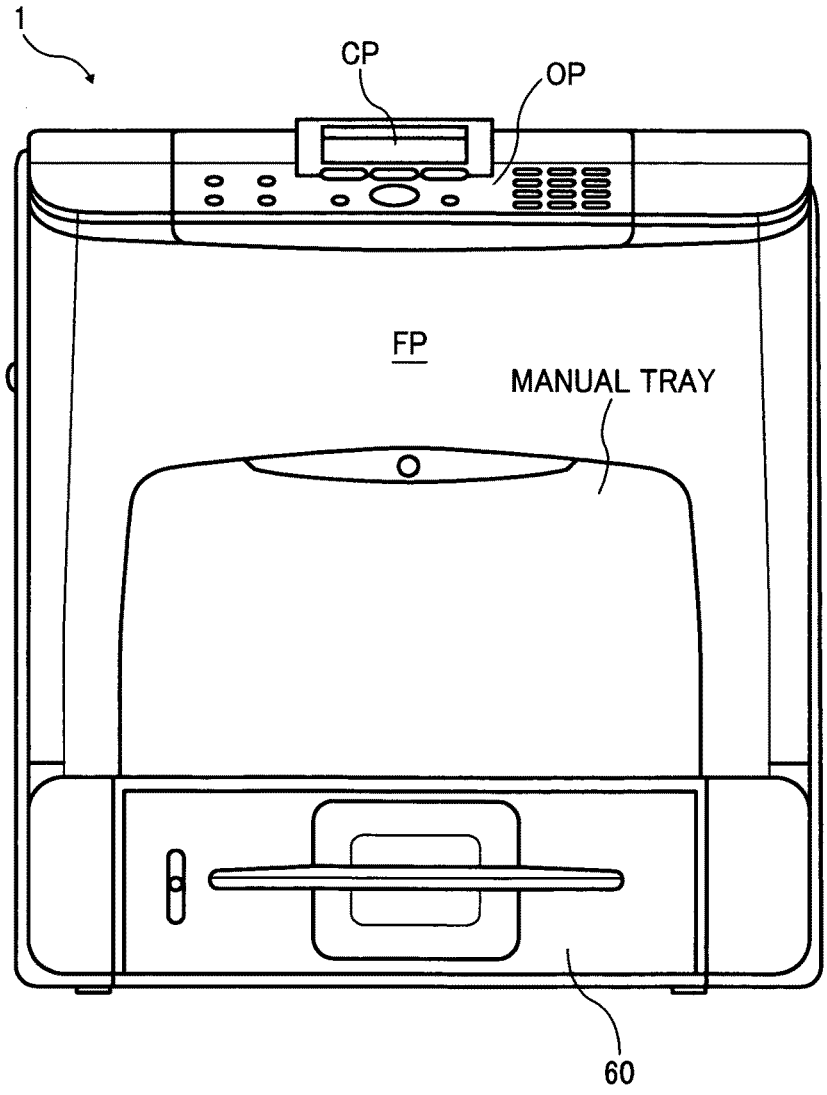
FIG. 2 is a front view of the color printer as illustrated in FIG. 1.
Figure 3:
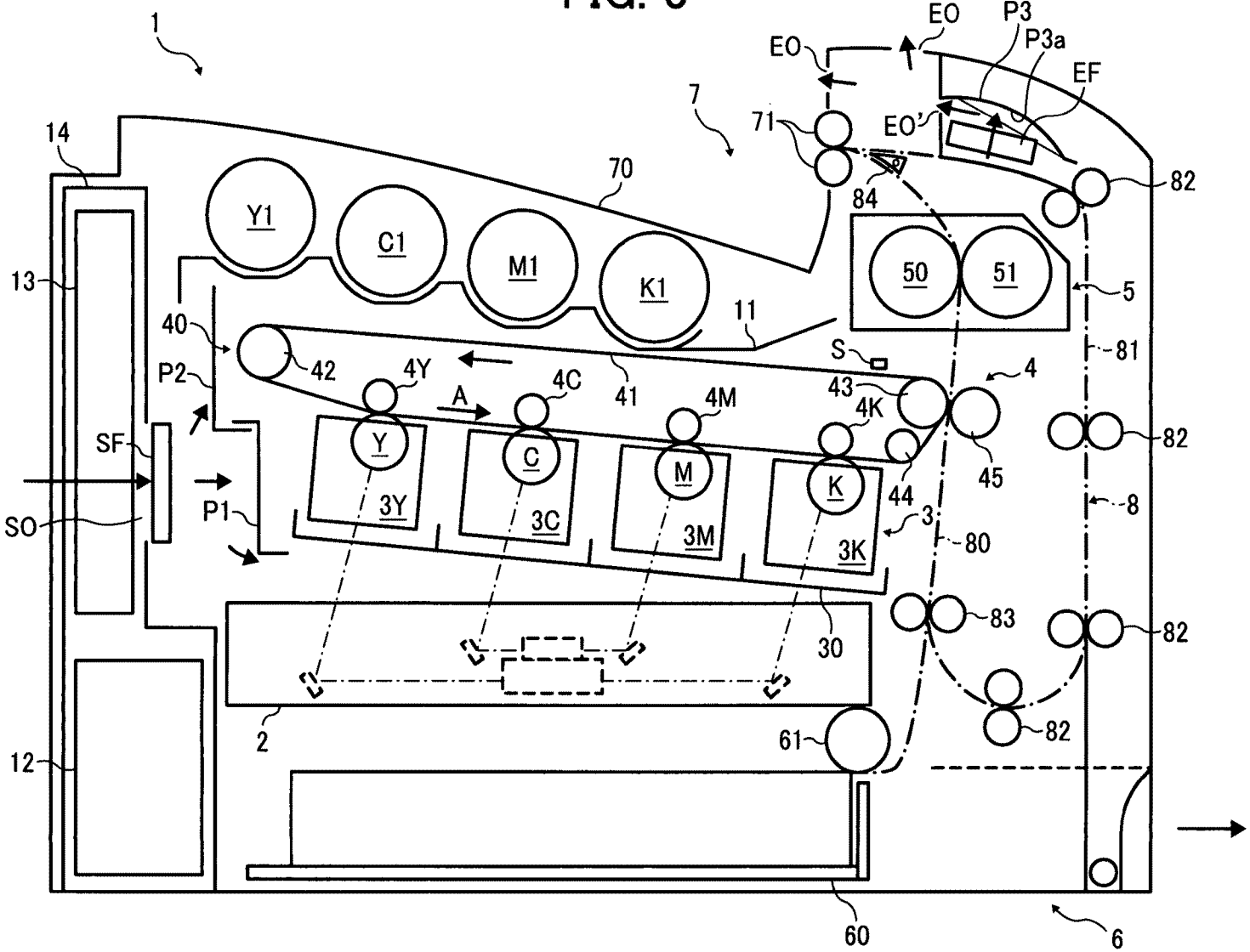
FIG. 3 is an explanatory perspective view of the color printer as illustrated in FIG. 1, seen from a left side.

With reference to FIGS. 1 through 3, an entire configuration of an image forming apparatus according to an embodiment of the present invention will now be described.

As illustrated in FIGS. 1 through 3, the image forming apparatus is a color printer 1 of a vertical-sheet-conveyance type capable of discharging printed sheets onto an upper surface of the apparatus. This color printer 1 mainly includes: an apparatus body 10 being a chassis of the entire image forming apparatus, a writing unit 2 provided in a substantially central portion of the apparatus body 10, an image forming section 3 provided above the writing unit 2, a transfer section 4 provided above the image forming section 3, a fixing section 5 provided above the transfer section 4 and at an upper position of the apparatus body 10 closer to one side wall, a sheet feed section 6 provided at a lowermost position, a sheet discharge section 7 formed on an upper surface of the apparatus body 10, a sheet conveyance path 8 provided between the sheet feed section 6 and the sheet discharge section 7, and the like.

The writing unit 2 includes a polygon mirror and fθ lenses and serves as an exposure unit. Specifically, the writing unit 2 is configured to scan while emitting laser beams modulated based on image data input from a PC and the like, to selectively expose a peripheral surface of a uniformly charged photoreceptor, to be described later, and reducing a surface potential of the irradiated part, thereby forming an electrostatic latent image on the photoreceptor drum.

The image forming section 3 is configured to mainly include four image forming units 3Y, 3C, 3M, and 3K, for each of the three primary colors of yellow, cyan, and magenta, and black. The image forming units 3Y, 3C, 3M, and 3K are arranged from upstream in this order along a moving direction of a peripheral surface as indicated by arrows A in FIG. 3 of an intermediate transfer belt 41, which will be described later. Photoreceptor drums Y, C, M, and K are latent image carriers rotating and driving in the clockwise direction (see FIG. 6). Each of the image forming units 3Y, 3C, 3M, and 3K is an image forming unit and includes one of corresponding photoreceptor drums Y, C, M, and K at a central portion, and other units, not shown, such as a charging unit, a developing unit, a cleaning unit, and the like. Specifically, the charging unit uniformly charges each of the photoreceptor drums Y, C, M, and K by charging the outside surfaces thereof, the developing unit renders electrostatic latent images that the writing unit 2 forms on each of the photoreceptor drums Y, C, M, and K, into mono-color toner images using and transferring corresponding colors of toner, and the cleaning unit cleans and collects residual toner remaining on the surface of the photoreceptor drums Y, C, M, and K after the transfer process.

Each of the image forming units 3Y, 3C, 3M, and 3K is guided by a guide rail 30 to be attached to/detached from the apparatus body 10 in a frontward pulling direction of FIG. 3 (which is a right and left direction in FIG. 1). A protection plate P1, which is a first protection member, is provided for protection whenever any of the image forming units 3Y, 3C, 3M, and 3K is/are detached from the apparatus body 10, to protect a user or service staff from a fingertip injury caused by getting caught in an air supply fan SF, to be described later, or from touching a high-voltage power supply board 12 or a control board 13 being a precision material which tends to be damaged easily.

The transfer section 4 uses an indirect transfer method transfer member mainly including a transfer unit 40 which is detachable from the apparatus body 10. This transfer unit 40 mainly includes an intermediate transfer belt 41, an endless belt serving as an intermediate transfer body having a multi-layered structure formed of elastic resins, three support rollers 42, 43, and 44, which support and are stretched over by the intermediate transfer belt 41, and four primary transfer rollers 4Y, 4C, 4M, and 4K facing corresponding photoreceptor drums Y, C, M, and K, respectively, with the intermediate transfer belt 41 sandwiched therebetween.

Further, the support roller 43 is a driving roller coupled with a driving means, not shown, and serves to rotatably drive the intermediate transfer belt 41 in the arrow A direction of FIG. 3. In addition, a secondary transfer roller 45 is provided at a position facing the driving roller 43 with the intermediate transfer belt 41 sandwiched therebetween.

Each of the primary transfer rollers 4Y, 4C, 4M, and 4K is a contact applying system transfer bias (voltage) applying means which is provided, from a concern of image deterioration due to a small gap discharge, offset slightly downstream in the conveyance direction of the intermediate transfer belt 41 (i.e., arrow A direction in FIG. 3) from a direct opposite a position having a shortest center-to-center distance to each of the corresponding photoreceptor drums Y, C, M, and K with the intermediate transfer belt 41 sandwiched therebetween. Each of the primary transfer rollers 4Y, 4C, 4M, and 4K is coupled to a bias power supply source, not shown, and is configured to apply a primary transfer bias to the intermediate transfer belt 41 from a rear surface, that is, an inner peripheral surface of the intermediate transfer belt 41.

The secondary transfer roller 45 is biased at an outside periphery of the driving roller 43 by a biasing means, not shown, and is pressed against the intermediate transfer belt 41, thereby forming a secondary transfer nip. The driving roller 43 serves as a contact-type transfer bias applying means coupled to the bias power supply source, not shown in the figure. In addition, the secondary transfer roller 45 also serves as a transfer bias applying means. In such a case, the transfer bias with a polarity opposite to that of the toner image to be transferred will be applied.

Similarly to the case of protection plate P1 of the image forming unit, a protection plate P2, a second protection member, is provided to protect a user or service staff from a fingertip injury caused by getting caught in the air supply fan SF or from touching the high-voltage power supply board 12 or the control board 13. The bottom end of the protection plate P2 is joined with the protection plate P1.

Further, various sensors S are provided along an upper surface of the intermediate transfer belt, including a toner sensor to detect toner deposition concentration of the toner images transferred to the outside surface of the intermediate transfer belt 41, a mark sensor to detect transfer positions of toner images, and the like. The toner deposition concentration sensor is used for concentration adjustment and color shift adjustment, and the mark sensor is used for controlling transfer positions or a registration roller pair, which will be described later.

The fixing section 5 is formed of a fixing roller 50 having a heat generation means, not shown, and a pressure roller 51, which is pressed by a biasing means, not shown, against the fixing roller 50 so as to be contacted with pressure or separated therefrom. The pressure roller 51 contacts the fixing roller 50 with pressure, thereby forming a fixing nip. A copied sheet being conveyed thereto is heated and pressed at the fixing nip, and the toner image transferred by the transfer section 4 is melted onto the copied sheet and fixed thereon.

The sheet feed section 6 is formed of a sheet feed cassette 60 containing, as a stock, a predetermined size of sheets as a sheet material (that is, sheet-like members including resinous sheets for OHP, paperboards, post cards, and the like) and configured to be pulled out in the arrow direction in the figure; a sheet feed roller 61 contacting the copy sheet stored as a stock with a predetermined pressure and feeding the copy sheet based on a control signal from a controlling means, not shown, to a sheet conveyance path 8, which will be described later; and a friction pad or a separation member, not shown, configured to separate the copy sheets conveyed in a overlaid manner one by one.

The sheet discharge section 7 includes a sheet discharge tray 70 formed of a slanted surface on an upper surface of the apparatus body 10, and a plurality of sheet discharge roller pairs 71 to discharge the copy sheet which has passed through the fixing section 5 from the apparatus body 10 to this sheet discharge tray 70. The copy sheets discharged from these sheet discharge roller pairs 71 are piled on the sheet discharge tray 70.

The sheet conveyance path 8 is a passage of the vertical-sheet-conveyance type to convey sheets from the sheet feed section 6 provided at the lowermost section of the apparatus body 10 to the sheet discharge section 7 formed on the upper surface of the apparatus body 10. The sheet conveyance path 8 includes a normal conveyance path 80 for the normal one-sided printing and a reverse conveyance path 81 in which the sheet is reversed for the duplex printing. Both the normal conveyance path 80 and the reverse conveying path 81 are provided with conveyance roller pairs 82 to convey the sheet for copying at a predetermined interval in accordance with the size of the copy sheet. The normal conveyance path 80 is also provided with a registration roller pair 83 to adjust a timing to convey the copy sheet to the secondary transfer nip based on a control means, not shown. In addition, a separation claw 84 is provided to switch between the normal conveyance path 80 and the reverse conveyance path 81.

New toner bottles Y1, C1, M1, and K1 each containing a corresponding color of new toner and appropriately supplying the new toner to each of the image forming units through a toner conveying means, not illustrated in the figure, are provided on a bottle tray 11. Further, the image forming apparatus 1 includes a power supply board 12 and a control board 13. The power supply board 12 and the control board 13 are supported and mounted in an electrical equipment rack 14.

Next, an image forming operation of the color-printer 1 will now be described with reference to FIG. 3.

In a case of forming a color image, first, upon an image forming operation starting in the color printer 1, each of the photoreceptor drums Y, C, M, and K is driven to rotate in the direction indicated by arrows in FIG. 3 and in the clockwise direction as seen from the left side wall of the color printer 1 of FIG. 1. During this rotating operation, a surface of each of the photoreceptor drums Y, C, M, and K is charged uniformly to a predetermined polarity, for example a negative polarity, by the corresponding charging means. Successively, the writing unit 2 directs laser beams onto the charged surface based on color-separated image data corresponding to the toner colors, and electrostatic latent images are formed on the peripheral surface of each of the photoreceptor drums Y, C, M, and K. Then, the electrostatic latent images are rendered as one-color toner image by each corresponding development means. Toner images of each color is impressed with a primary transfer bias by each of the corresponding primary transfer rollers 4Y, 4C, 4M, and 4K and sequentially transferred in an overlaid manner on the intermediate transfer belt 41, whereby full-color toner images are formed. When forming a mono-color image, the above operation is performed employing a predetermined photoreceptor drum of the mono-color image formation, for example, a photoreceptor drum K for black.

Meanwhile, a copy sheet which is stored in the sheet feed cassette 60 in the sheet feed section 6 is separated one by one by an operation of the sheet feed roller 61 and the friction pad and sent to the normal conveyance path 80. The copy sheet is then conveyed upward through the normal conveyance path 80 and the leading edge of the copy sheet abuts the registration roller pair 83 and stops there. By this abutting, the leading edge of the copy sheet is aligned in a normal state, that is, any skew of the sheet is corrected. Then, the registration roller pair 83 are rotated just as the color toner image formed on the intermediate transfer belt 41 reaches the secondary transfer nip, and the copy sheet is fed toward the secondary transfer nip.

Next, at the secondary transfer nip of the transfer section 4, a secondary transfer bias is applied and the full-color toner image on the intermediate transfer belt 41 is transferred, by a static electricity, to the copy sheet. The copy sheet is then transferred to the fixing nip of the fixing section 5. There, the copy sheet is applied with heat and pressure by the fixing roller 50 and the pressure roller 51, and the unfixed toner image carried on the copy sheet is fixed thereon. Thus, after the toner image is fixed on the copy sheet, the sheet discharge roller pair 71 rotates and allows the copy sheet to be discharged to the sheet discharge tray 70 of the sheet discharge section 7.

If the duplex printing is performed, after the trailing edge of the copy sheet has passed the fixing section 5, the sheet discharge roller pair 71 is configured to rotate reversely with the copy sheet sandwiched by the sheet discharge roller pair 71. Immediately before the start of reverse rotation, a leading edge of the claw of the separation claw 84 which is a conveyance path switching means moves downwards so as to block the normal conveyance path 80, whereby the conveyance direction of the copy sheet is switched and the copy sheet is conveyed to the reverse conveyance path 81. Then, the front and back sides of the copy sheet are reversed until the copy sheet rejoins the normal conveyance path 80 and the back side of the sheet can be printed. Thus, the image forming operation as described above may be performed repeatedly.

Next, with reference to FIGS. 3 through 18, the air supply and exhaust system of the color printer 1 of the present invention will now be described.

First, a general construction of the air supply and exhaust system according to an embodiment of the present invention will be described referring to FIG. 3.

The color printer 1 includes an air supply and exhaust system as a ventilation means, in which outside air is supplied through an air inlet and hot, moist air generated in the fixing section 5 and the image forming section 3 is exhausted from an exhaust outlet, thereby allowing the air to flow inside the apparatus body 10 to cool the apparatus. This air supply and exhaust system is formed of an air supply means and an exhaust means. The air supply means includes an air supply opening SO which has an opening provided on the apparatus body 10 and an air supply fan SF provided inside the air supply fan SF. The exhaust means includes an exhaust outlet EO which has an opening provided on the apparatus body 10 and an exhaust fan EF provided inside the exhaust outlet EO.

First, with reference to FIGS. 4 through 8, the air supply means will be described.

Figure 4:
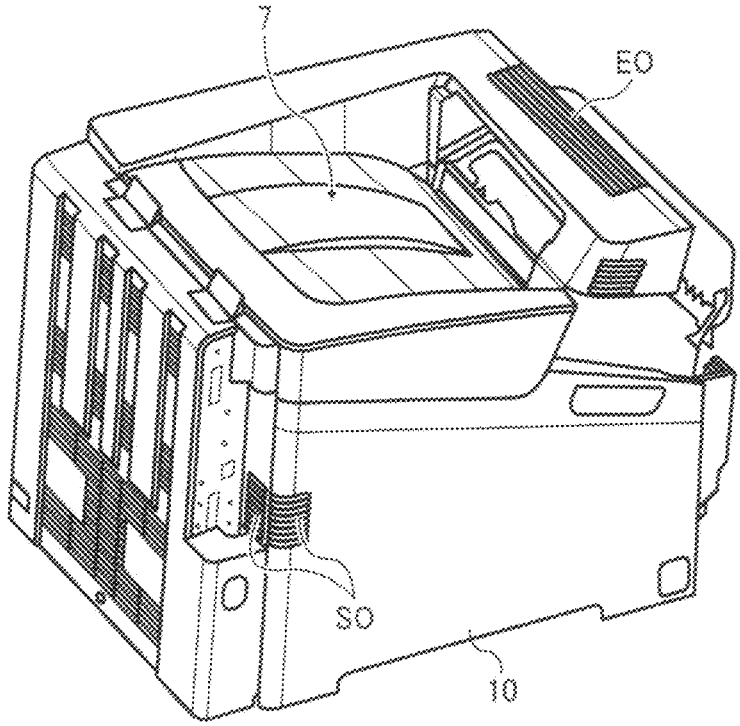
FIG. 4 is an oblique view mainly showing an external view of the back and left sides of the color printer in FIG. 1.
Figure 5:
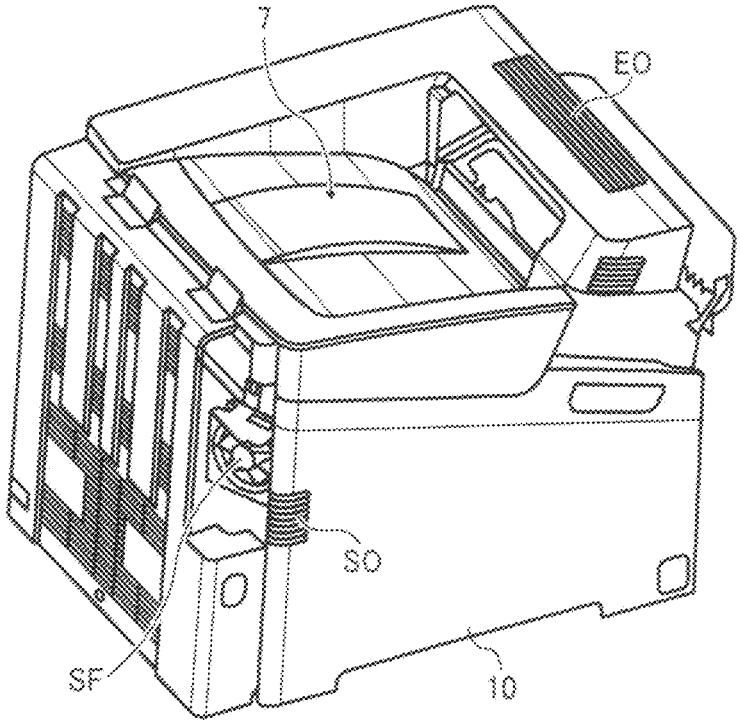
FIG. 5 is an oblique view showing a state of removing an air supply part cover from the color printer of FIG. 4 to mainly show a state in which an air supply fan is mounted.

As illustrated in FIG. 4, the air supply opening SO is an opening formed on the corner at the middle height and between the backside and the left wall of the apparatus body 10. The air supply opening SO is formed of a plurality of louver boards thereby preventing fingertips from entering from outside. As illustrated in FIG. 5, the air supply fan SF is provided inboard of the air supply opening SO. This air supply fan SF is a compact axial-flow fan with superior exhaust performance compared to other types of fans. The air supply fan SF is provided such that the bottom of the air supply fan SF is placed higher than the bottom surface of the guide rail 30. In addition, the air supply fan SF is provided with an air supply duct SD to guide the air introduced by the air supply fan SF from outside, as shown in FIG. 6.

Figure 6:
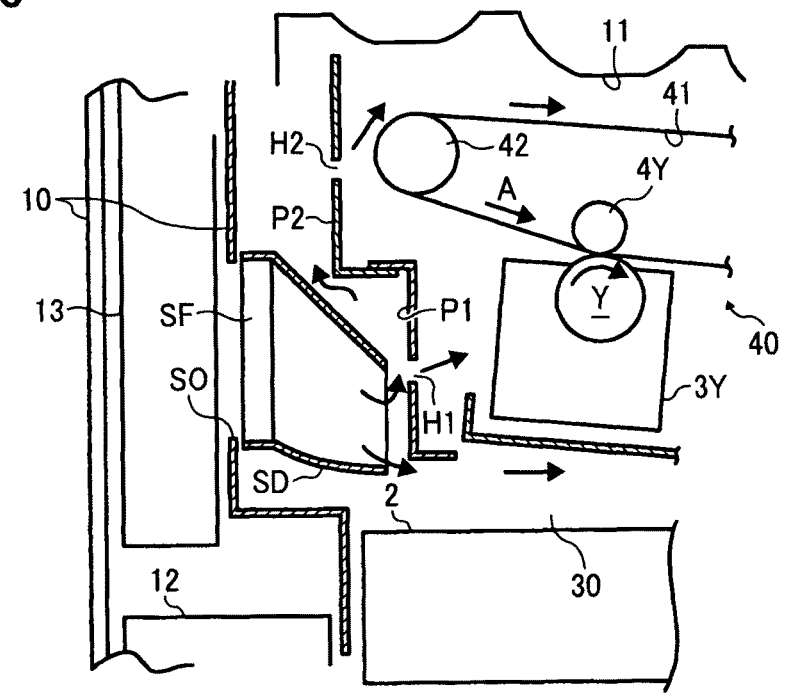
FIG. 6 is an enlarged partial view showing an internal structure of the vicinity of the air supply fan.
Figure 7:
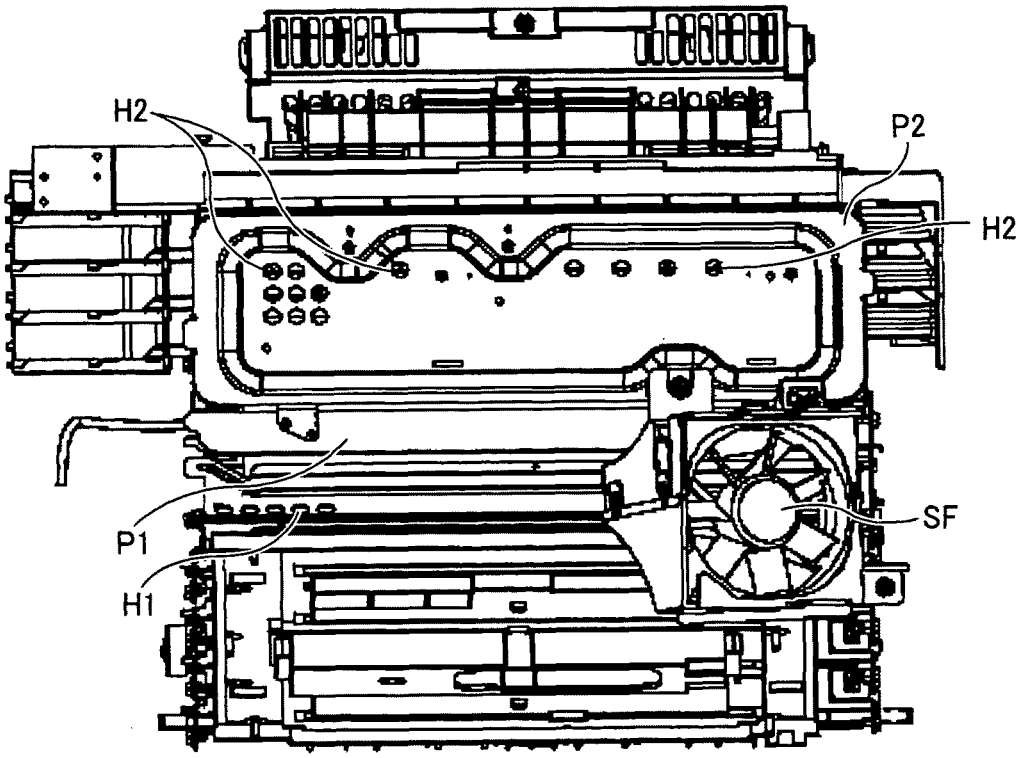
FIG. 7 is a rear side view showing an internal structure of a boundary of the air supply fan according to an embodiment of the present invention.
Figure 8:
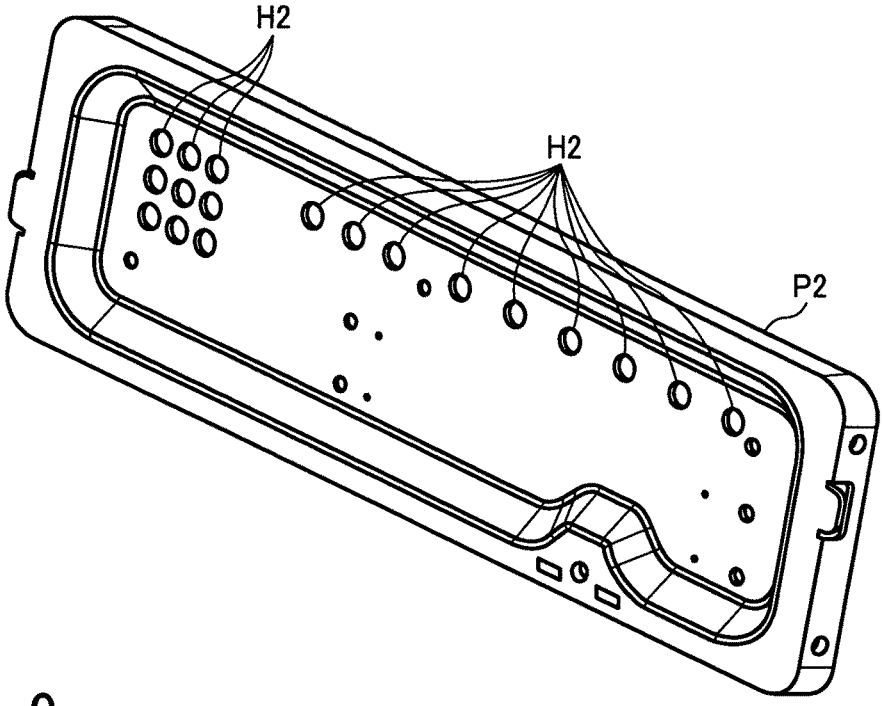
FIG. 8 is an oblique view showing a second protection member or plate according to an embodiment of the present invention.
Figure 9:
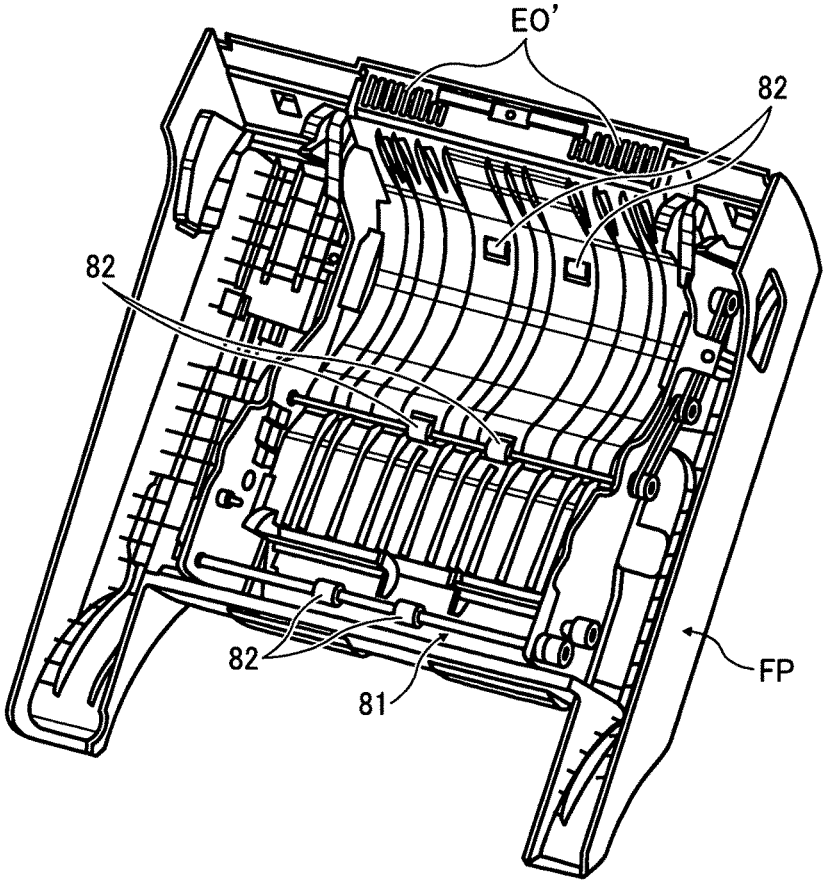
FIG. 9 is an oblique view mainly showing an inside of an openably closable panel or a front panel according to an embodiment of the present invention.
Figure 10:
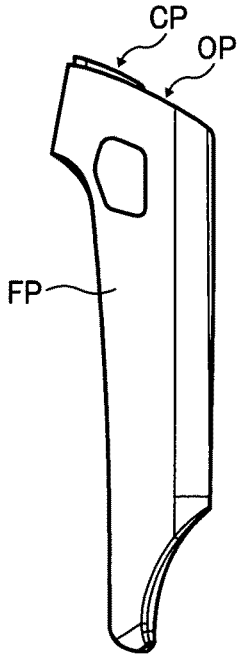
FIG. 10 is a left side view of the front panel as illustrated in FIG. 9.
Figure 11:
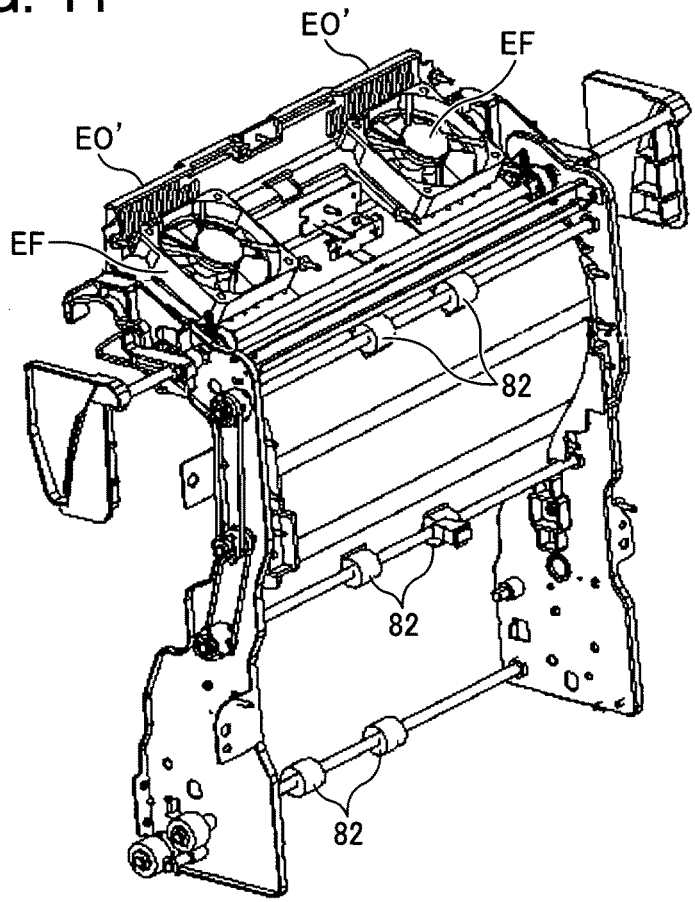
FIG. 11 is an oblique view mainly showing a framework of the front panel and an exhaust fan in FIG. 9.

As illustrated in FIG. 6, this air supply duct SD is fitted to an outside peripheral surface of the air supply fan SF. The air flow outlet of the air supply duct SD has a reduced diameter from its mounting portion and has a shape which is bent and descending downwardly. Using a property of the axial-flow fan in which the rotating flow becomes faster due to the action of a centrifugal force the farther away from the rotational axis, an airflow having a higher speed may be formed effectively in a gap between the bottom surface of the guide rail 30 and the upper surface of the writing unit 2. It is to be noted that the air supply duct SD is not limited to the shape illustrated in the present embodiment and the duct itself is not necessary, because even without it the air supply fan can introduce outside air to cool the fixing device 5 and other components.

In addition, the protection plate P1, the first protection member as described above, is provided in an air supply direction from the air supply fan SF with a clearance of more than 5 mm from the air flow outlet of the air supply duct SD, so that a substantially upper half of the air flow outlet is obstructed. The protection plate P1 has a plurality of airflow holes H1 each having a diameter of 10 mm or so and provided along the axial direction of the photoreceptor drums, so that the supplied air from the air supply fan SF flows to the image forming section 3. Accordingly, the upper half of the supplied air obstructed by the protection plate P1 passes through the clearance and flows along the protection plate P1 toward an upper side, and a part of the supplied air passes through the airflow holes H1 and cools the image forming section 3. Then, as illustrated in FIG. 6, there is a space at an upper portion of the air supply fan SF. The above-described protection plate P2, the second protection member, has a plurality of cutout airflow holes H2 each having a diameter of 10 mm or so, along the axial direction of the driving roller 43 (see FIG. 3) being a driving axis of the transfer unit 40, and the support roller 42 in FIG. 6. Accordingly, the flow toward the upper side along the protection plate P1 generated by the air supply fan SF increases the pressure in the space, and this pressure forms an air flow from the airflow holes H2 along the upper surface of the transfer unit 40 (see also FIG. 14).

Successively, referring to FIGS. 1 and 9 through 13, the exhaust means and an openably closable panel will be described.

The apparatus body 10 of the color printer 1 includes a front panel FP hinged along its bottom side and which serves as an openably closable panel, allowing, at a time of failure such as a paper jam or the like, the sheet conveyance path 8 to be accessed and a jammed sheet to be removed, etc. On the upper surface of this front panel FP, as illustrated in FIG. 1, an operation panel OP used to operate the color printer 1 and a liquid-crystal monitor CP are arranged. The operation panel OP and the LC monitor CP include electronic boards OPa and CPa, respectively (see FIG. 13).

An exhaust fan EF provided directly above the fixing section 5, in a state in which the front panel FP is closed, and along the inner surface of the front panel FP facing the reverse conveyance path 81, serves to exhaust heat and moisture generated in the fixing section 5 and the image forming section 3. This exhaust fan EF is a compact, axial-flow fan having a higher exhaust performance compared to the other types of fans, and is mounted so that the axial direction, which is an exhaust direction, is substantially perpendicular to the inner surface of the front panel along the sheet conveyance path. Accordingly, the radial direction of the fan having a large width, including all line vectors perpendicular to the axis direction of the exhaust fan, is provided along the inner surface of the front panel, that is, parallel to the front panel. Thus, this type of exhaust fan may be produced at a low cost since it is a multi-purpose product, and can prevent wasted space, thereby achieving the greater compactness of an entire apparatus.

Figure 12:
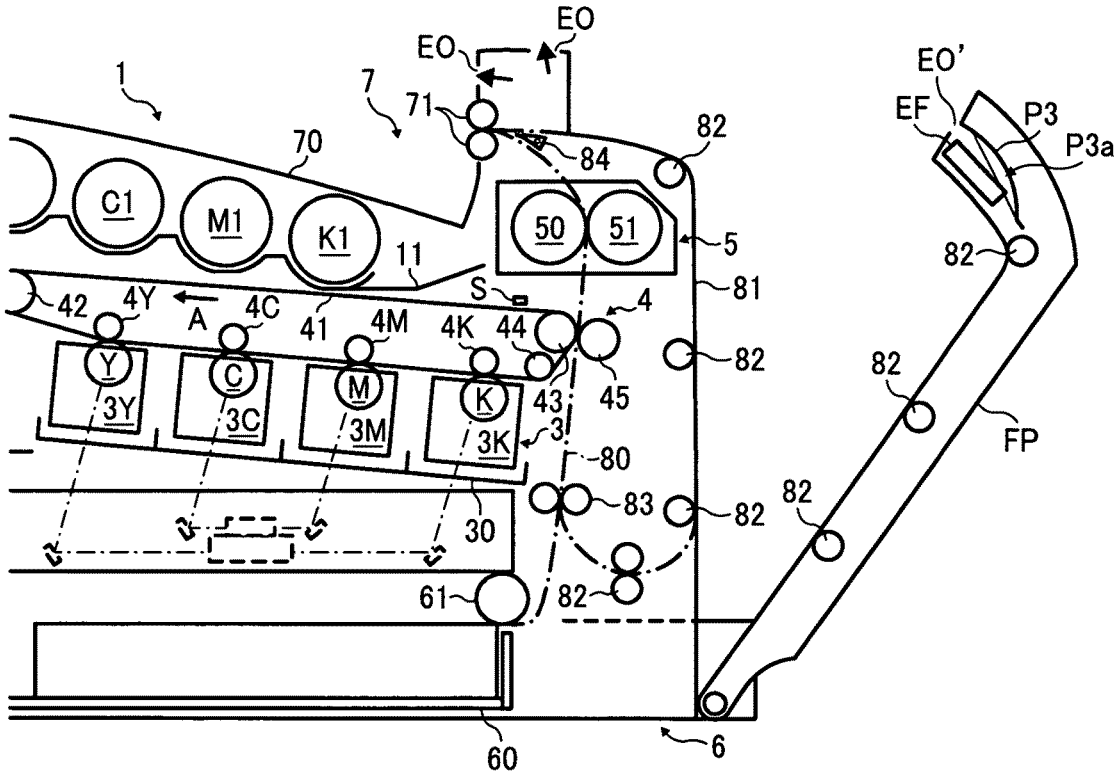
FIG. 12 is a partial view of FIG. 3 showing a state in which the front panel is open.

As illustrated in FIG. 12, a deflection plate P3 cutting across a downstream side of the exhaust direction of the exhaust fan EF to deflect the exhaust by approximately 90 degrees is provided. By this deflection plate P3, the exhaust airflow path from the exhaust fan EF downstream in the exhaust direction of the exhaust fan EF to an exhaust outlet EO' provided at an edge of the front panel FP is made narrower than the airflow path in the upstream side in the exhaust direction of the exhaust fan EF. Thus, due to the principle of energy conservation, as between the airflow path between the air supply opening SO to the exhaust outlet EO, the airflow around the exhaust airflow from the exhaust fan EF to the exhaust outlet EO' provided at an end portion of the front panel FP has a comparatively higher speed, thereby effectively preventing condensation around this portion.

In addition, the deflection plate P3 is provided with a deflector section P3*a* substantially arc-shaped in cross-section that deflects the airflow of the exhaust fan EF with reduced pressure loss. Accordingly, the hot, moist air generated at the fixing section 5 may be effectively exhausted.

Figure 13:
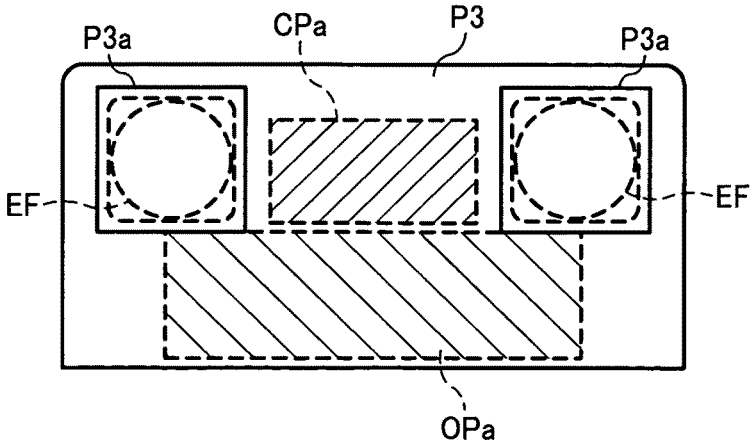
FIG. 13 is view illustrating a position of a deflection plate and an electronic board related to an embodiment.
Figure 14:
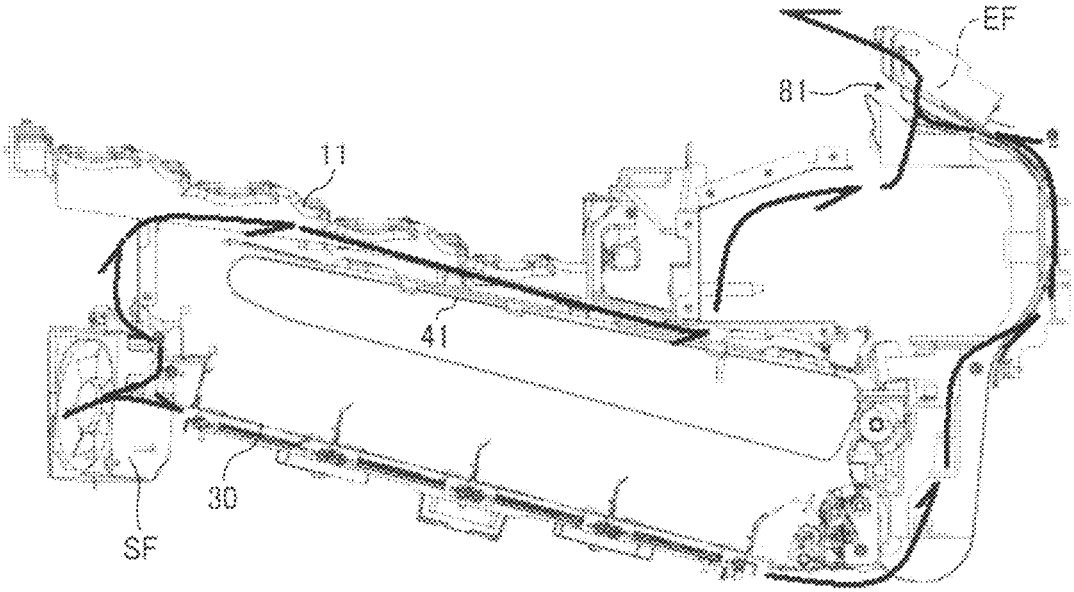
FIG. 14 is a partial view of a left inner side of the apparatus to show airflow of air supply and exhaust system according to an embodiment of the present invention.
Figure 15:
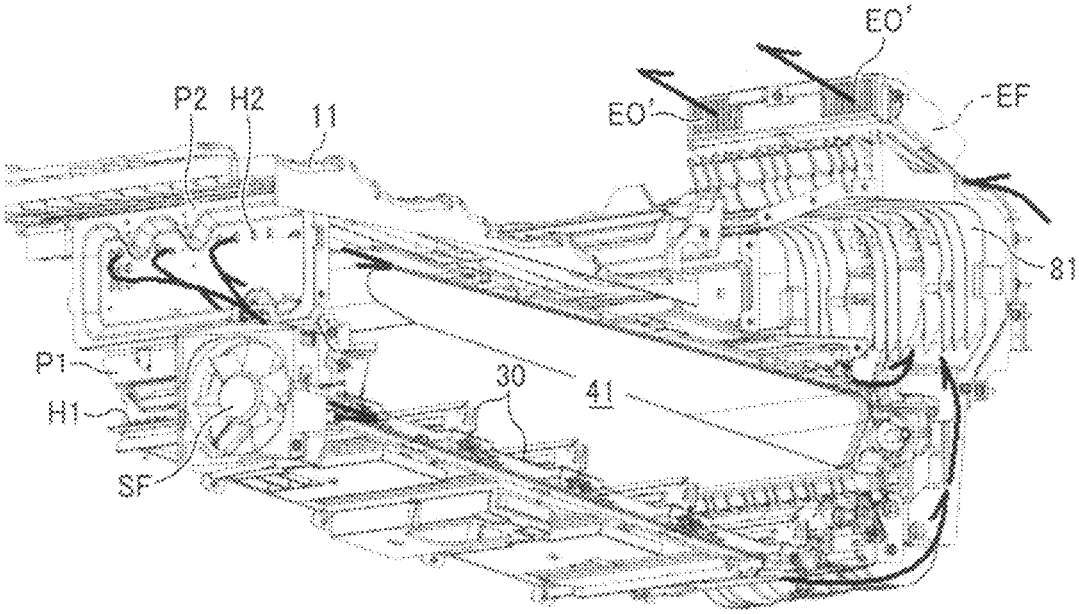
FIG. 15 is an oblique view from a left-rear side of the apparatus to mainly show airflow of the air supply and exhaust system.

As illustrated in FIG. 13, the electronic boards OPa and CPa are provided at portions excluding the positions where the exhaust fan EF is perpendicular to the deflection plate P3. Accordingly, the heat of the exhaust airflow is not directly transmitted to the electronic boards OPa and CPa. Therefore, the deflection plate P3 need not be formed as an insulating member nor have an increased thickness. In addition, risk of malfunction of the electronic boards OPa and CPa is also reduced.

Next, referring to FIGS. 14 through 18 and FIG. 6, the flow of air generated inside the color printer apparatus body 10 by the air supply and exhaust system will be described.

As illustrated in the above figures, the outside air taken in from the air supply opening SO by the air supply fan SF is guided by the air supply duct SD and a part thereof flows along the lower surface of the guide rail 30, thereby cooling the image forming section 3. The remaining flow of air abuts the protection plate P1 to become an upward flow, and further, a remaining part passes through the plural cutout airflow holes H2 provided on the protection plate P2 cut out along the axial direction of the driving roller 43, to thus reach an entire upper portion of the intermediate transfer belt 41. With this flow, an air flow is formed between the fixing section 5 and the transfer section 4, thereby preventing heat from moving due to convection from the fixing section and being capable of cooling the transfer section 4 effectively.

Also, it is frequently the case that important sensors S such as a toner deposition concentration sensor, a mark sensor, and the like, are provided on the upper surface of the intermediate transfer belt 41. If these sensors malfunction, various defective images may result. By forming an air flow on the upper surface of the intermediate transfer belt 41, these sensors S may be cooled effectively and can perform detection operation reliably.

Figure 16:
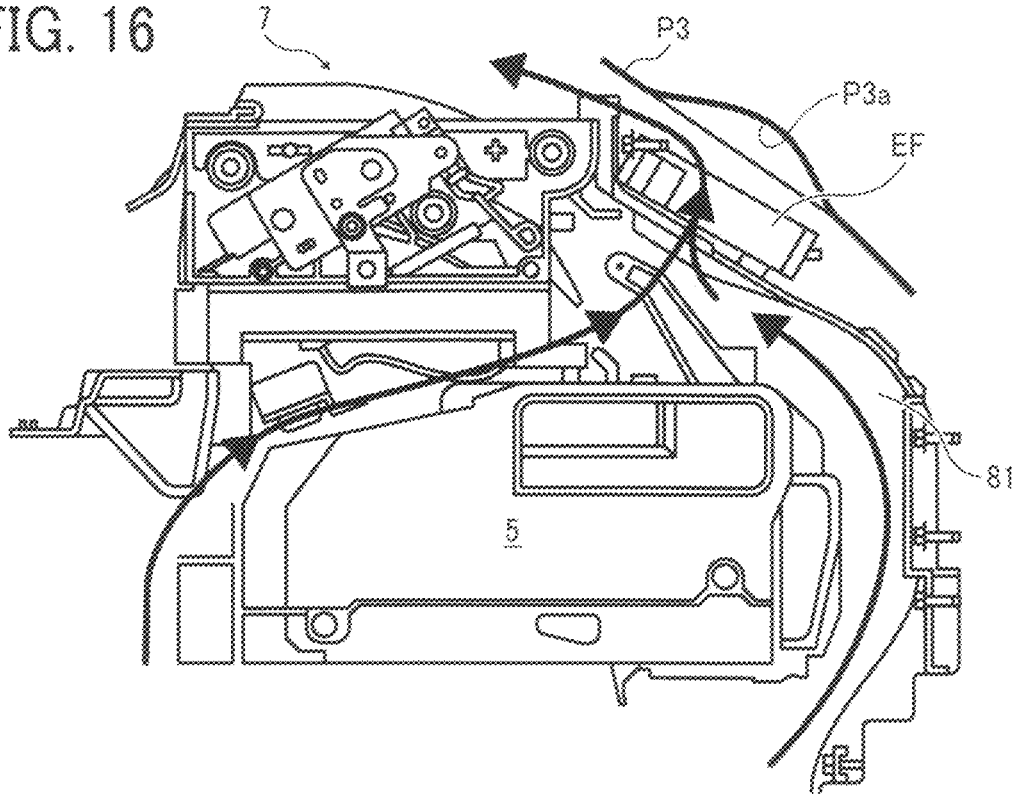
FIG. 16 is a view from a left side of the apparatus to mainly show airflow of the air supply and exhaust system around the fixing device.
Figure 17:
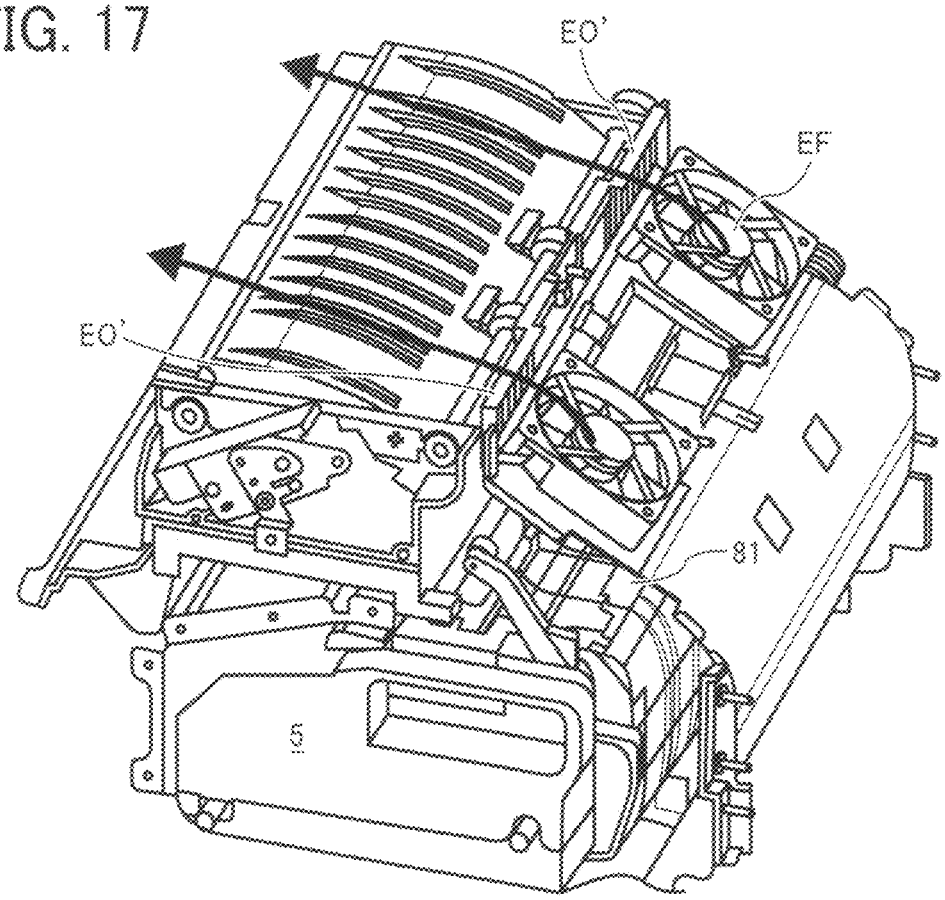
FIG. 17 a left-front side of the apparatus to mainly show airflow around the exhaust airflow path.
Figure 18:
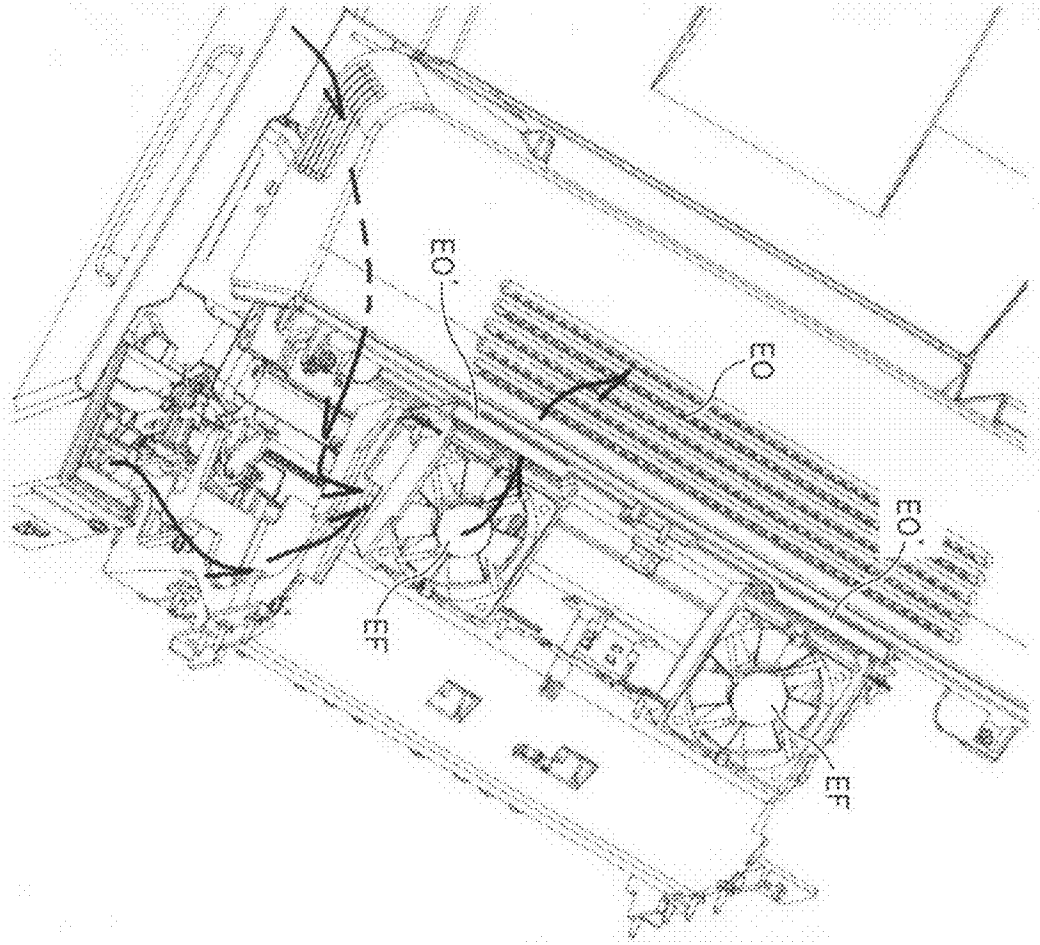
FIG. 18 is an enlarged partial view around the exhaust an in the oblique view of FIG. 17.

As illustrated in FIGS. 16 through 18, the air flow below the bottom surface of the guide rail 30 and above the upper surface of the intermediate transfer belt 41 is drawn in by the exhaust fan EF, passes through the sheet conveyance path 8 (including the normal conveyance path 80 and the reverse conveyance path 81) and then is discharged to the outside of the fixing section 5, thereby cooling the fixing section 5. Then, the above air together with the hot, moist air, including the heat generated at the fixing section 5 and the moisture generated from the sheet, is exhausted from the exhaust outlet EO by the exhaust fan EF.

Herein, the exhaust airflow discharged from the exhaust fan EF is deflected substantially orthogonally by the deflection plate P3 as illustrated in FIGS. 16 and 17. The exhaust airflow path up to the exhaust outlet EO provided at an edge portion of the front panel FP is configured to be narrower than the other exhaust airflow paths. Accordingly, the airflow around this portion is relatively faster, and the water vapor evaporated from the sheet heated by the fixing section 5 can be effectively exhausted before being diffused to the various other parts inside the apparatus body 10. Thus, even though condensation may occur in this portion, it is blown away by the high-speed exhaust airflow thus generated.

Further, at a position perpendicular to the deflection plate P3 of the exhaust fan EF where the air pressure of the deflection plate P3 is received directly, a deflector section P3*aa* substantially arc shaped in cross-section is provided. The air of the exhaust fan EF is deflected along the arc-shaped deflector section P3*a*, and therefore, the pressure loss when being deflected may be reduced.

According to the aforementioned embodiments, a novel and optimal color printer 1 provided with an optimal air supply and exhaust system is provided, in which the entire apparatus may be made compact, eliminating wasted space and effectively exhausting the heat and moisture generated in the fixing section. In the optimal color printer 1, by making the exhaust airflow path narrower than that at an upstream of the exhaust fan, the airflow speed of the exhaust airflow path which is an upper side of the sheet conveyance path is increased, thereby preventing condensation from forming around the exhaust airflow path. Accordingly, the sheet conveyance path may be prevented from getting wet due to condensation.

Although an image forming apparatus of a four-drum tandem-type indirect transfer method has been described in the aforementioned embodiments, the apparatus of the present invention is not limited thereto. Accordingly, the present invention may be applied to any of the image forming apparatuses as far as the image forming apparatus includes a fixing device and an air exhaust means to exhaust hot, moist air generated at the fixing member.

Additional modifications and variations of the present invention are possible in light of the above teachings. It is therefore to be understood that, within the scope of the appended claims, the invention may be practiced other than as specifically described herein.

What is claimed is:

1. An image forming apparatus, comprising:

a fixing device to fix an image to a sheet with heat and pressure;

an air exhaust member to exhaust air having a high temperature and moisture generated by the fixing device;

an exhaust fan provided in the air exhaust member, mounted at an angle to a sheet conveyance path internal to the apparatus above the fixing device, an exhaust airflow path internal to the apparatus narrowing toward a downstream side in an air exhaust direction of the exhaust fan, and a deflection plate provided across the exhaust airflow path downstream from the exhaust fan, wherein the exhaust air discharged from the exhaust fan is deflected substantially orthogonally by the deflection plate, and wherein the deflection plate is provided with a deflector section substantially arc-shaped in cross-section to reduce pressure loss at a portion where air pressure of the exhaust fan is received.

2. The image forming apparatus as claimed in claim 1, wherein the deflection plate narrows the exhaust airflow path toward the downstream side thereof.

3. The image forming apparatus as claimed in claim 1, wherein the exhaust fan is an axial-flow fan and the deflection plate lies across an axial direction of the exhaust fan.

4. The image forming apparatus as claimed in claim 1, wherein the exhaust fan is provided along an inner surface of an openably closable panel of the apparatus, the openably closable panel hinged along one side to allow access to the sheet conveyance path when opened.

5. The image forming apparatus as claimed in claim 2, wherein an electronic board is provided opposite the exhaust fan, with the deflection plate interposed between the exhaust fan and the electronic board.

6. The image forming apparatus as claimed in claim 5, wherein the electronic board is provided anywhere except positions where the exhaust fan is perpendicular to the deflection plate.

7. The image forming apparatus as claimed in claim 1, further comprising an air supply fan configured to take in outside air and provided at an inner side of an air supply opening provided in a body of the image forming apparatus, the air supply fan being provided with an air supply duct to guide the supplied air from the air supply fan toward a lower surface of an image forming unit of the image forming apparatus configured to form an image.

8. The image forming apparatus as claimed in claim 7, wherein the air supply fan is an axial-flow fan and a bottom edge of an air flow outlet of the air supply duct is disposed lower than a bottom edge of the air supply fan.

9. The image forming apparatus as claimed in claim 7, further comprising:

an image forming unit attachably detachable from the body of the image forming apparatus;

a guide rail to guide the image forming unit; and a first protection member to prevent contact with the air supply fan in a state in which the image forming unit is detached from the apparatus body, wherein supplied air from the air supply fan is caused to abut the first protection member to be guided toward a lower surface of the guide rail.

10. The image forming apparatus as claimed in claim 9, wherein the first protection plate includes a plurality of cutout airflow holes therein to allow the supplied air to pass through the first protection plate, the plurality of cutout airflow holes being arrayed along a driving axis direction of the image forming unit.

11. The image forming apparatus as claimed in claim 7, further comprising:

a transfer device to transfer an image to a sheet, the transfer device attachably detachable from the body of the image forming apparatus; and a second protection plate to prevent contact with the air supply fan in a state in which the transfer device is detached from the body of the image forming apparatus, wherein the second protection plate includes a plurality of cutout airflow holes configured to allow the supplied air to pass therethrough, the plurality of cutout airflow holes arrayed along a driving axis direction of the transfer device, and wherein the supplied air is guided to abut the second protection member to pass through the plurality of cutout airflow holes toward an upper surface of an intermediate transfer belt of the transfer device.

12. The image forming apparatus as claimed in claim 11, further comprising:

a toner deposition concentration sensor to measure a toner deposition concentration of a toner image transferred to an outer peripheral surface of the intermediate transfer belt; and a mark sensor to detect a transfer position of the toner image, the toner deposition concentration sensor and the mark sensor being provided along the upper surface of the intermediate transfer belt.

13. The image forming apparatus as claimed in claim 9, wherein a bottom of the air supply fan is placed higher than a bottom surface of the guide rail.

14. The image forming apparatus as claimed in claim 7, further comprising an air supply duct fitted to an outside peripheral surface of the air supply fan.

15. The image forming apparatus as claimed in claim 14, wherein an air flow outlet of the air supply duct has a reduced diameter from a mounting portion and has a shape which is bent and descending downwardly.

16. The image forming apparatus as claimed in claim 9, wherein an upper half of the supplied air obstructed by the first protection member passes through a clearance and flows along the first protection member toward an upper side, and a part of the supplied air passes through a plurality of cutout airflow holes and cools the image forming apparatus.

17. The image forming apparatus as claimed in claim 16, wherein remaining flow of air passes through a plurality of cutout airflow holes provided on a second protection member.

18. The image forming apparatus as claimed in claim 7, wherein the air supply fan is provided near a back of the image forming apparatus and the exhaust fan is provided near a front of the image forming apparatus.

19. An image forming apparatus, comprising:

a fixing device to fix an image to a sheet with heat and pressure;

an air exhaust member to exhaust air having a high temperature and moisture generated by the fixing device;

an exhaust fan provided in the air exhaust member, mounted at an angle to a sheet conveyance path internal to the apparatus above the fixing device, an exhaust airflow path internal to the apparatus narrowing toward a downstream side in an air exhaust direction of the exhaust fan, and a deflection plate provided across the exhaust airflow path downstream from the exhaust fan, wherein the exhaust air discharged from the exhaust fan is deflected substantially orthogonally by the deflection plate, wherein the deflection plate narrows the exhaust airflow path toward the downstream side thereof, and wherein an electronic board is provided opposite the exhaust fan, with the deflection plate interposed between the exhaust fan and the electronic board.

20. An image forming apparatus, comprising:

a fixing device to fix an image to a sheet with heat and pressure;

an air exhaust member to exhaust air having a high temperature and moisture generated by the fixing device;

an exhaust fan provided in the air exhaust member, mounted at an angle to a sheet conveyance path internal to the apparatus above the fixing device, an exhaust airflow path internal to the apparatus narrowing toward a downstream side in an air exhaust direction of the exhaust fan, a deflection plate provided across the exhaust airflow path downstream from the exhaust fan, and an air supply fan configured to take in outside air and provided at an inner side of an air supply opening provided in the image forming apparatus, the air supply fan being provided with an air supply duct to guide the supplied air from the air supply fan toward a lower surface of an image forming unit of the image forming apparatus configured to form an image, wherein the exhaust air discharged from the exhaust fan is deflected substantially orthogonally by the deflection plate, and wherein the air supply fan is provided near a back of the image forming apparatus and the exhaust fan is provided near a front of the image forming apparatus.

* * * * *